US010619850B2

(12) United States Patent
Wyatt et al.

(10) Patent No.: US 10,619,850 B2
(45) Date of Patent: Apr. 14, 2020

(54) AUTOMATIC CANDLE EXTINGUISHER

(71) Applicants: Brooke Wyatt, Fishers, IN (US); Vince Rizzo, Westfield, IN (US)

(72) Inventors: Brooke Wyatt, Fishers, IN (US); Vince Rizzo, Westfield, IN (US)

( * ) Notice: Subject to any disclaimer, the term of this patent is extended or adjusted under 35 U.S.C. 154(b) by 43 days.

(21) Appl. No.: 15/912,686

(22) Filed: Mar. 6, 2018

(65) Prior Publication Data

US 2018/0252409 A1 Sep. 6, 2018

Related U.S. Application Data

(60) Provisional application No. 62/467,582, filed on Mar. 6, 2017.

(51) Int. Cl.
*F23Q 25/00* (2006.01)
*F23D 3/26* (2006.01)

(52) U.S. Cl.
CPC ..... *F23Q 25/00* (2013.01); *F23D 3/26* (2013.01)

(58) Field of Classification Search
CPC ..... F23Q 25/00; F23D 3/26; F04D 29/601
USPC ..... 417/234, 423.15
See application file for complete search history.

(56) References Cited

U.S. PATENT DOCUMENTS 4,524,912 A * 6/1985 Jones ..... A01M 7/0046 239/150
5,304,035 A * 4/1994 Carter ..... F04D 25/084 224/258
6,120,262 A * 9/2000 McDonough ..... H05B 37/0272 318/16
6,454,539 B1 * 9/2002 Santos ..... F04D 25/084 416/63
2005/0048428 A1 * 3/2005 Lim ..... F23Q 25/00 431/145
2006/0045749 A1 * 3/2006 Beckman ..... F04B 49/065 417/1
2008/0076082 A1 * 3/2008 Wolfson ..... F23Q 25/00 431/145
2009/0239180 A1 * 9/2009 Lim ..... F23Q 25/00 431/2

OTHER PUBLICATIONS

Pelonis Technologies, RFB 1804 Micro Blower, Jun. 7, 2014 , https://web.archive.org/web/20140607032808/https://catalog.pelonistechnologies.com/viewitems/micro-blowers/all-categories-micro-blowers-rfb 1804-micro-blower (Year: 2014).*

* cited by examiner

*Primary Examiner* — Grant Moubry
*Assistant Examiner* — Rabeeul I Zuberi
(74) *Attorney, Agent, or Firm* — Maginot, Moore & Beck, LLP

(57) ABSTRACT

An automatic extinguisher for the flame of a candle includes a fan sized and configured to be supported by a candle, and a controller connected to the electrical fan and operable to activate and de-activate the fan. The controller includes a timer for activating the fan after a pre-determined first time interval to direct air from the fan to the flame of the candle, and operable to de-activate the fan after a pre-determined second time interval shorter than the first time interval.

5 Claims, 2 Drawing Sheets

AUTOMATIC CANDLE EXTINGUISHER

REFERENCE TO RELATED APPLICATION

This application is a utility application claiming priority to U.S. Provisional Application No. 62/467,582, filed on Mar. 6, 2017, the entire disclosure of which is incorporated herein by reference.

BACKGROUND

According to the National Fire Protection Association, one third of the hone candle fires are started in the bedroom, with 32% associated with a death and 47% associated with some injury. Falling asleep with a candle still burning was a factor in 11% of the reported home candle fires, with 30% of those reports resulting in a death. Notwithstanding the aesthetic and spiritual aspect of burning candles, the risk of lack of attention to the candles creates a significant hazard. There is a need for a system that automatically extinguishes a candle before it turns into a fire hazard.

SUMMARY

In one embodiment, an automatic extinguisher for the flame of a candle includes a fan sized and configured to be supported by a candle, and a controller connected to the electrical fan and operable to activate and de-activate the fan. The controller includes a timer for activating the fan after a pre-determined first time interval to direct air from the fan to the flame of the candle, and operable to de-activate the fan after a pre-determined second time interval shorter than the first time interval.

In another embodiment, n automatic extinguisher for the flame of a candle comprises a source of compressed air, a controllable valve having an inlet fluidly connected to the source of compressed air and an outlet, and tubing fluidly connected to the outlet of the controllable valve, the tubing having an outlet for dispensing air. A support is provided for supporting the tubing with the outlet of the tubing arranged to direct air onto the flame of the candle. The extinguisher further includes a controller connected to the controllable valve and operable to open the valve to permit compressed air to flow from the source to the outlet of the tubing and to close the valve to stop compressed air from flowing to the outlet of the tubing. The controller includes a timer for opening the valve after a pre-determined first time interval to direct air from the outlet of the tubing to the flame of the candle, and operable to close the valve after a pre-determined second time interval shorter than the first time interval.

DETAILED DESCRIPTION

Figure 1:
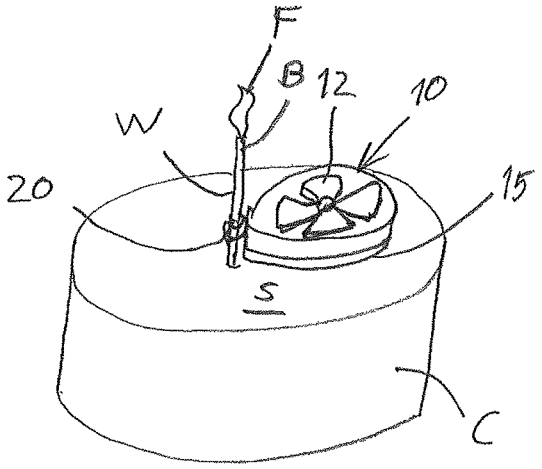
FIG. 1 is a perspective view of a candle with an automatic flame extinguisher according to one embodiment of the present disclosure.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains In one aspect of the present invention, an automatic extinguisher 10 is provided that can be mounted directly on a candle C, as shown in FIG. 1. The extinguisher 10 in this embodiment, the extinguisher is mounted to the wick W of the candle C to orient the extinguisher relative to the flame F of the burning candle. Thus, the extinguisher 10 may include a ring 20 that is configured to receive the wick W of the candle, such as by sliding the ring over the wick to position the extinguisher on the surface S of the candle. Alternatively, the ring 20 may be a clamp that can engage the wick W to support the extinguisher above the surface S of the candle. The clip 20 can be configured to slide along the wick as the wick burns off while staying engaged to the remaining portion of the wick.

The automatic extinguisher 10 includes a micro-fan 12 that is arranged to direct a flow of air to the flame F of the wick W with sufficient air flow to extinguish the flame. The air flow is sufficiently long in duration to ensure that the flame F is extinguished and that the burning end B of the wick W is sufficiently cooled. Thus, in one embodiment, the fan 12 runs for 15 seconds, with a flow rate of 0.1-0.6 CFM. In one embodiment, the fan 12 is a micro-fan, and in one specific embodiment the fan is an RFB2008 micro blower manufactured by Pelonis Technologies, Inc. Alternatively, the fan 12 can be the RFB1804 Slim Micro Blower manufactured by Pelonis. The fan preferably has a dimension that allows the fan to be situated at the top of a conventional candle C. In a specific embodiment, the fan has a maximum dimension of 18×18×4 mm, although smaller envelopes are possible. This envelop for the extinguisher 10 should be sufficiently small to work with a wide range of candles of varying sizes. It is contemplated that this embodiment of the fire extinguisher with the ring/clip 20 can be used on a wide variety of candles, such as candlesticks, pillar candles and jar candles.

Figure 2:
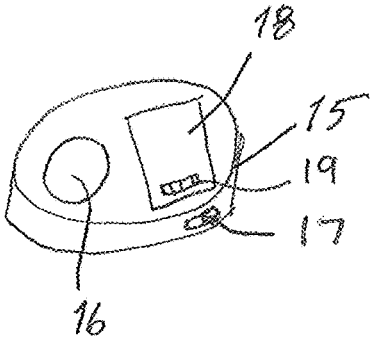
FIG. 2 is a perspective view of the controller for the extinguisher shown in FIG. 1.
Figure 3:
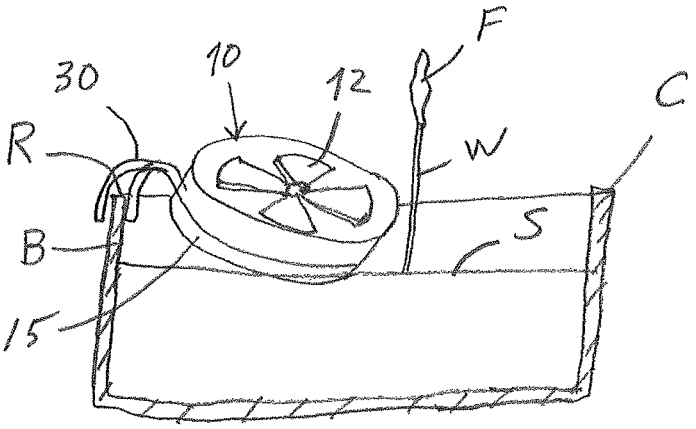
FIG. 3 is a side partial cross-sectional view of a candle with an automatic flame extinguisher according to a further embodiment of the present disclosure.
Figure 4:
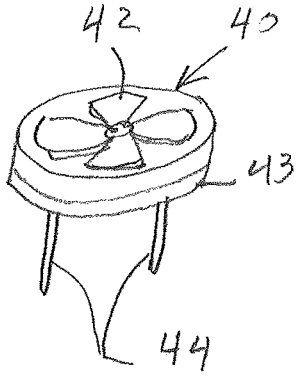
FIG. 4 is a perspective view of an automatic flame extinguisher according to another embodiment of the present disclosure.

The extinguisher 12 includes a control device 15 associated with the fan to control the operation of the fan, as shown in FIG. 2. The controller 15 includes a power supply, such as a battery 16 for driving the fan, which can be a conventional watch battery. Preferably, the battery is a button cell that is small enough to fit within the envelop of the micro blower, as described above. The fan 12 is preferably configured to operate at a low voltage, such as 3 V, so that the button cell can be a CR2032/DL2032 lithium battery. Alternatively, the controller 15 and fan 12 can be connected to an external power supply, such as a DC transformer connected to an AC source. The controller 15 includes a control element 18 that includes circuitry or a microprocessor on a conventional circuit board configured to control the activation of the fan. An on-off switch 17 can be provided to energize the control device 15.

The control element 18 can include a timer that activates the fan 12 after a preset time interval and stops the fan and/or shuts down the extinguisher 10 after another preset time interval. The control element 18 can include a dip switch 19 or other switch to allow the user to select predetermined time intervals for activation of the fan, such as 30, 60, 90 or 120 minutes. The shut-off time interval can be fixed, such as at 15 seconds, or may also be user selectable by a separate dip switch arrangement. The on-off switch can be configured to restart the timer or to slow down the timer depending on how the start/stop button is depressed.

The controller 15 can be integral with the fan or micro blower 12 with the on-off switch 17 and dip switches 19 externally accessible to the user and with an access opening to receive the battery 16. Alternatively, the controller 15 can be a separate unit that is connectable to the fan 12, such as with the fan seated on the controller to cover the battery 16 and control element 18.

It is further contemplates that the controller 15 can incorporate a wireless communication feature that allows activation by a remote control. The control component 15, and in particular the circuit board, can include a wireless receiver transmitter, such as RF, Bluetooth, WiFi or other type of signal. A separate remote or even an app on a handheld device, such as a smart phone, can be used to activate the extinguisher and initiate the timer functions. The remote controller can also be used to activate the fan to extinguish the candle without involving the timing function. It is contemplated that each candle in a home or building can include an extinguisher 10, each being responsive to the hand held device to extinguish all the candles at once, such as when the user is retiring for the evening or has left the building.

In an alternative embodiment shown in FIG. 2, the candle extinguisher 10 is provided that is mounted to the body B of ajar or tumbler type candle C. In particular, the extinguisher 10 includes a clip 30 that can seat or clip onto the rim R of the candle body B. The clip may be configured for a friction fit to the rim or may include a more active gripping or clamping feature, such as a locking set screw in one arm of the clip or a spring-biased hinge holding the arms of the clip to the rim. The clip 30 supports the extinguisher 10 so that the fan 12 is aimed at the flame F of the candle. The clip may be fixed to the extinguisher 10, such as to the body of the controller 15, or may be configured to also clip onto the extinguisher. In one aspect, the clip 30 may be configured to allow the extinguisher 10 to rest on the surface S of the candle as the candle burns. It is known that the surface of the candle S will recede as the candle burns, so supporting the fan 12 in a manner that follows the receding surface will ensure that the fan remains aimed at the flame F as the wick W burns down with the candle.

In a further an extinguisher 40 with a fan 42 ad controller 43 that may be similar to the extinguisher 10, includes one or more spikes or rods 44 that are configured to be pressed into the candle wax to support the fan. The extinguisher 40 can thus be placed on the surface S of the candle C in a position so that the fan can direct air flow onto flame F of the wick W. Since the fan may be offset from the wick W, the fan may be provided with a higher air flow rate than the fans in the previous embodiments. At any rate, the air flow rate of the fan must be sufficient to blow out the flame F and burning end B of the wick W. The extinguisher 40 is particular suited for use with jar or tumbler candles.

Figure 5:
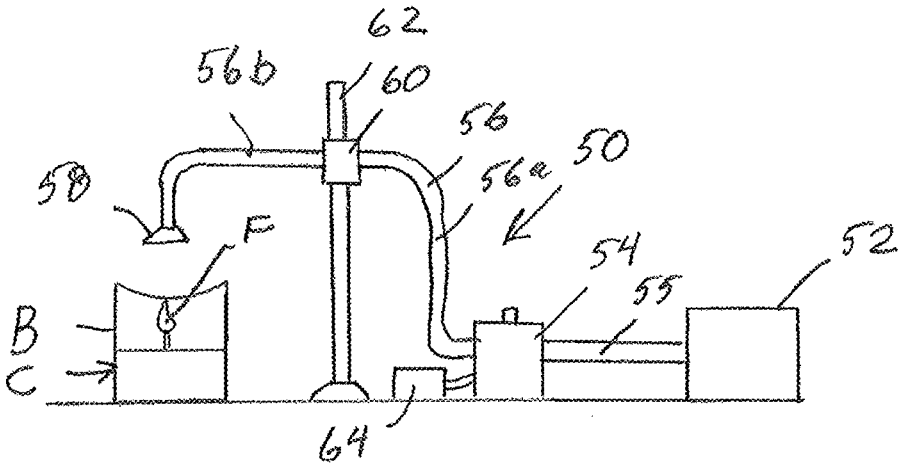
FIG. 5 is a side view of an automatic flame extinguisher according to an additional embodiment of the present disclosure.

In a further embodiment, a candle extinguisher 50 utilizes a supply of compressed air 52, as shown in FIG. 5. A controllable valve 54, such as a solenoid valve, is connected at its inlet by tubing 55 to the supply 52. The outlet for the valve is connected to outlet tubing 56, with the end of the tubing 56 aligned to direct a puff of air to extinguish the flame F. The end of the outlet tubing 56 can include an outlet nozzle 58 to help direct or concentrate the puff of air to more efficiently extinguish the flame F. The nozzle 58 is shown in FIG. 5 directly above the candle C and flame F; however, the nozzle can be in any particular orientation relative to the candle provided that the nozzle can direct the puff of air to the flame.

The outlet tubing 56 is supported on a stand 62 by a mounting block 60. The mounting block 60 may be configured to be vertically adjustable along the height of the stand 62 to accommodate different heights of candles. The mounting block can be of any configuration that is capable of supporting the tubing 56 at a fixed location, yet permit easy repositioning of the tubing. It is contemplated that the outlet tubing 56 may be two separate tubing portions 56*a*, 56*b*, with one portion 56*a* connected between the outlet of the valve 54 and an inlet of the mounting block 60 and the other portion 56*b* connected at an outlet of the block 60 in communication with the inlet of the mounting block. The tubing portion 56*b* may be of generally rigid construction, such as a rigid plastic or a metal, so that the tubing portion 56*b* can maintain its position to direct air flow onto the candle flame F. Alternatively, tubing portion 56*b* may be supported by a horizontal bar carried by the mounting block 60. In this alternative, the height of the support bar is adjusted by the mounting block, thereby adjusting the height of the outlet nozzle 58. The other tubing, such as tubing portion 56*a* and tubing 55 may be a flexible tubing, although a rigid tubing is also acceptable.

The valve 54 is controlled by a controller 64 connected to the valve. In one embodiment, the valve 54 is a solenoid valve that is actuated by a voltage from the controller 64. Thus, the controller 64 may include an electrical relay, such as a solid-state relay, that delivers low voltage electricity to the solenoid valve to actuate the valve to its open state in which air flows from the source 52, through tubing 55, through the valve 54 and into the outlet tubing 56. When the relay is closed, electricity to the valve is terminated and the valve returns to its closed state in which no air flows through the valve. The controller 64 includes a power supply, such as a battery, or can be connected to an external source. The controller 64 further includes a circuit board or microprocessor, such as the control element 18 described above, that is operable to energize the relay after a pre-set time interval to open the valve 54, and to de-energize the relay after a second pre-set time interval to close the valve 54. The controller 64 may be configured like the controller 15 described above to permit user selection of the first pre-set time interval to extinguish the candle flame. Since only a short puff of air is required to extinguish the flame F, the compressed air source 52 may be small, such as the 12 oz. disposable compressed air cans used to clean computer keyboards. The valve may be adapted to mount on the outlet to the compressed air can and to operate the can's own outlet valve, or the inlet to the valve may be adapted for engagement with and opening of the outlet nozzle of the can.

The present invention provides an automatic extinguisher for candles that allows the candle C to burn for a reasonable duration, but provides a mechanism for automatically extinguishing the flame F of the candle if it is left unattended. With the control element 15 disclosed herein, the user can continually reset the timer if he/she is attending to the candle, and then once the candle is unattended the timer will perform its function to automatically extinguish the candle flame after the predetermined interval. The automatic candle extinguisher alleviates the worry about leaving a candle unattended. Whether the candle user has left the house or has gone to sleep, the unattended candle will be extinguished to reduce the risk of accidental fire.

As disclosed herein, the extinguishers 10, 40, 50 are mounted to the candle itself, and specifically is mounted within the top of the candle C near the wick W. Alternatively, the automatic extinguisher can be attached to the outside of the candle, with the fan supported in position to extinguish the flame with a puff of air. In this alternative, the fan 12, 52, is supported on a beam or rod, that is itself supported on a stand on which the candle is placed. As a further alternative, the beam supporting the fan can be supported by a clip that fits around the body of the candle. In all of the embodiments, the height of the fan, or at least the height and direction of the air flow from the fan, can be adjusted based on the height of the wick W.

The present disclosure should be considered as illustrative and not restrictive in character. It is understood that only certain embodiments have been presented and that all changes, modifications and further applications that come within the spirit of the disclosure are desired to be protected.

What is claimed is:

1. An automatic extinguisher for the flame of a candle comprising:

a fan supported by a candle;

a controller connected to the electrical fan and operable to activate and de-activate the fan, the controller including a timer for activating the fan after a pre-determined first time interval to direct air from the fan to the flame of the candle, and operable to de-activate the fan after a pre-determined second time interval shorter than the first time interval; and a clip connected to the fan and configured for receiving and engaging a wick of the candle to support the fan on the wick.

2. The automatic extinguisher of claim 1, wherein the clip is a ring that encircles the wick.

3. The automatic extinguisher of claim 1, wherein the controller includes a power supply and a control element including an electrical circuit board or a microprocessor.

4. The automatic extinguisher of claim 3, wherein the control element includes dip switches operable to change the pre-determined first time interval.

5. The automatic extinguisher of claim 4, wherein the control element is configured to provide the first time interval as 30, 60, 90 and 120 minutes with a corresponding dip switch configuration.

* * * * *